US011008812B2

(12) United States Patent
Korte et al.

(10) Patent No.: US 11,008,812 B2
(45) Date of Patent: May 18, 2021

(54) DRILL BIT FOR PERCUSSIVE DRILLING, A DRILL BIT ASSEMBLY, AND A METHOD FOR MANUFACTURING SUCH A DRILL BIT

(71) Applicant: ROBIT OYJ, Lempäälä (FI)

(72) Inventors: Pasi Korte, Lempäälä (FI); Antti Leino, Ylöjärvi (FI)

(73) Assignee: ROBIT OYJ, Lempäälä (FI)

( * ) Notice: Subject to any disclaimer, the term of this patent is extended or adjusted under 35 U.S.C. 154(b) by 0 days.

(21) Appl. No.: 16/489,822

(22) PCT Filed: Feb. 28, 2018

(86) PCT No.: PCT/FI2018/050147
§ 371 (c)(1),
(2) Date: Aug. 29, 2019

(87) PCT Pub. No.: WO2018/158503
PCT Pub. Date: Sep. 7, 2018

(65) Prior Publication Data

US 2020/0011136 A1 Jan. 9, 2020

(30) Foreign Application Priority Data

Mar. 1, 2017 (FI) ..... 20175189

(51) Int. Cl.
*E21B 10/38* (2006.01)
*E21B 10/62* (2006.01)
*E21B 10/60* (2006.01)

(52) U.S. Cl.
CPC ..... *E21B 10/38* (2013.01); *E21B 10/60* (2013.01); *E21B 10/62* (2013.01)

(58) Field of Classification Search
CPC ..... E21B 10/38; E21B 10/36; E21B 10/60; E21B 10/62
See application file for complete search history.

(56) References Cited

U.S. PATENT DOCUMENTS 5,025,875 A * 6/1991 Witt ..... E21B 10/56 175/393
5,029,657 A 7/1991 Mahar et al.
(Continued)

FOREIGN PATENT DOCUMENTS

CN 201276971 Y 7/2009
CN 205400597 U 7/2016
(Continued)

OTHER PUBLICATIONS

International Search Report (PCT/ISA/210) dated Jun. 18, 2018, by the European Patent Office as the International Searching Authority for International Application No. PCT/FI2018/050147.
(Continued)

*Primary Examiner* — Taras P Bemko
*Assistant Examiner* — Yanick A Akaragwe
(74) *Attorney, Agent, or Firm* — Buchanan Ingersoll & Rooney PC

(57) ABSTRACT

A drill bit, drill bit assembly and related methods of manufacture as disclosed involve a head portion having a circumference and a face surface, and a shank portion extending longitudinally from a side of the head portion opposite to the face surface. A central flushing channel extends longitudinally through the shank portion and a distance within the head portion, and a lateral flushing channel extends from the central flushing channel to the circumference of the head portion. A first portion of the lateral flushing channel is inclined, in a flushing fluid flowing direction, towards the face surface with respect to said second portion, and correspondingly, a second portion is inclined, in a flushing fluid flowing direction, towards the shank portion.

17 Claims, 4 Drawing Sheets

(56) References Cited

U.S. PATENT DOCUMENTS

| | | | | |
|---|---|---|---|---|
| 2007/0039761 | A1 | 2/2007 | Cruz | |
| 2017/0081923 | A1* | 3/2017 | Nakamura | E21B 7/208 |
| 2018/0058148 | A1* | 3/2018 | Zhang | E21B 10/55 |

FOREIGN PATENT DOCUMENTS

| | | | | |
|---|---|---|---|---|
| FI | 103430 | B | 6/1999 | |
| FI | 20130297 | A | 4/2015 | |
| FI | 126596 | B | 2/2017 | |
| GB | 1071418 | A | 6/1967 | |
| RU | 2579821 | C1 | 4/2016 | |
| WO | 9611323 | A1 | 4/1996 | |
| WO | 02052123 | A1 | 7/2002 | |
| WO | WO-2010070190 | A1 * | 6/2010 | E21B 7/20 |
| WO | 2015107262 | A1 | 7/2015 | |

OTHER PUBLICATIONS

Written Opinion (PCT/ISA/237) dated Jun. 18, 2018, by the European Patent Office as the International Searching Authority for International Application No. PCT/FI2018/050147.

First Office Action dated Nov. 4, 2020, by the Chinese Patent Office in corresponding Chinese Patent Application No. 201880014918.8, and an English Translation of the Office Action. (13 pages).

Search Report dated Oct. 28, 2020, by the Chinese Patent Office in corresponding Chinese Patent Application No. 201880014918.8. (1 pages).

* cited by examiner

DRILL BIT FOR PERCUSSIVE DRILLING, A DRILL BIT ASSEMBLY, AND A METHOD FOR MANUFACTURING SUCH A DRILL BIT

FIELD OF THE DISCLOSURE

The present disclosure relates to drill bits for percussive drilling, and more particularly to such drill bits where flushing fluid is conducted via a lateral flushing fluid channel. The present disclosure further concerns a drill bit assembly having such a drill bit and a method for manufacturing such a drill bit assembly.

BACKGROUND OF THE DISCLOSURE

Flushing fluid is commonly used to flush drill cuttings from the drill hole, ahead of the drill bit. This enables the drill bit to effectively act on the ground to be drilled instead of on excessive drill cuttings residing in the drill hole.

It has been recognized that using flushing fluid might cause problems when drilling in sensitive ground conditions. In soft ground, the flushing fluid may remove an excessive amount ground surrounding the drill bit, which is known as over-drilling. This is particularly problematic when drilling piles to the ground, as a too big drill hole does not support the pile in a desired manner, making the pile less capable of supporting a structure on top of it. Another problem associated with using flushing in sensitive ground conditions is that the flushing fluid may travel long distances along certain ground formations, such as clay formations. Consequently, in densely built areas, flushing fluid may unexpectedly travel up to existing piles or foundations and weaken their structure. Thus, it has been a general concern to minimize the effects of the flushing fluid when drilling.

BRIEF DESCRIPTION OF THE DISCLOSURE

An object of the present disclosure is to provide a drill bit and a drill bit assembly with which the problems associated to drilling in sensitive grounds conditions can be overcome or effectively alleviated. A further object of the disclosure to provide a method of manufacturing such drill bit.

The objects of the disclosure are achieved by a drill bit, drill bit assembly and method for manufacturing a drill bit, which are characterized by what is stated in the independent claims. The preferred embodiments of the disclosure are disclosed in the dependent claims.

The disclosure is based on the idea of providing a lateral flushing channel extending from a central flushing channel of a drill bit head portion to the circumference thereof in such a way that that the flushing fluid exiting the channel may be directed for enhancing a pressure differential between the surrounding of the circumference of the head portion and the face surface, while enabling the lateral flushing channel to be formed so as to minimize the deflection required for the flushing fluid to flow from the central flushing channel to the lateral flushing channel.

An advantage of the disclosure is that flushing fluid flow via the lateral flushing channel is facilitated by providing smooth directional transitions, i.e. a smooth general contour resulting in smaller flow resistance, and consequently, pressure loss, thus increasing the capability of the corresponding flushing fluid flow to convey drill cuttings. This advantage is particularly prominent when drilling deep drill holes requiring a relatively high flushing fluid flow and/or velocity to carry drill cuttings to the surface. As an increased flow rate via the lateral flushing fluid channel increases, a pressure differential between the circumference and the face surface of the head portion is also increased, drawing drill cuttings from the periphery of the face surface along with the flushing fluid flow originating from the lateral flushing fluid channel. Such a pressure differential acts much like a vacuum effect, drawings drill cuttings from ahead of the face surface of the head portion. Consequently, as a synergistic effect, the flow of flushing fluid via the drill bit face surface can be decreased, thus reducing the risk associate with drilling in sensitive ground conditions. Moreover, providing a lateral flushing channel according to the disclosure enables flushing fluid flow to be directed towards the shank portion, i.e. the surface, even in connection with drill bits having a relatively large diameter with respect to the height thereof.

BRIEF DESCRIPTION OF THE DRAWINGS

In the following the disclosure will be described in greater detail by means of preferred embodiments with reference to the accompanying drawings, in which.

It should be noted that the enclosed drawings are—for the purpose of clarity, simplified illustration of various embodiments of the disclosure. Therefore, the accompanied drawings should not be interpreted as restricting the scope of the disclosure.

DETAILED DESCRIPTION OF THE DISCLOSURE

Figure 1:
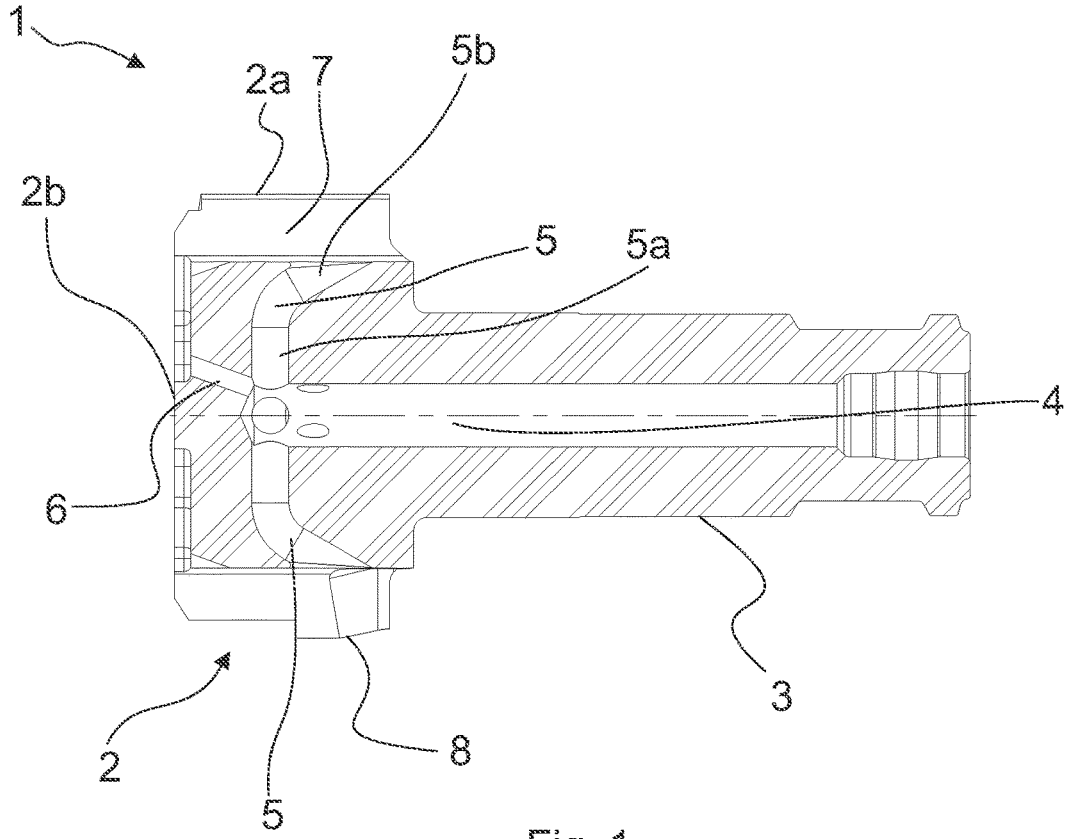
FIGS. 1-4 show alternative embodiments of a drill bit according to the disclosure, illustrated as a cut-view.

FIG. 1 illustrates a cut view of drill bit 1 comprising a head portion 2 having a circumference 2*a* and face surface 2*b*. Furthermore, a shank portion 3 extends longitudinally from the head portion 2 in a direction opposite to the face surface 2*b*. A central flushing channel 4 extends longitudinally through the shank portion 3 and a distance within the head portion 2. From the central flushing channel 4, a lateral flushing channel 5 extends up to the circumference 2*b* of the head portion 2. A first portion of the lateral flushing channel 5*a* extends in direction transverse to the central flushing channel 4, whereas a second portion 5*b* of the lateral flushing channel 5 is inclined, in a flowing direction of the flushing fluid, towards the shank portion 3, with respect to the first portion 5*a* of the lateral flushing channel 5. A smooth transition between the first and second portions 5*a*, 5*b* is provided. The drill bit 1 is further equipped with a face surface flushing channel 6, extending between the central flushing channel 4 and the face surface 2*b*, partially via the lateral flushing channel 5. On the circumference 2*a* of the head portion, a flushing groove 7 is arranged, extending longitudinally through the circumference. Moreover, the lateral flushing channel, namely the second portion 5*b* thereof, is arranged to extend up to the lateral flushing groove 7. Pilot bit coupling means 8 are also provided on the circumference 2*a* of the head portion 2 for coupling the drill bit 1 with a corresponding ring bit in a percussion and rotation transmitting manner.

Figure 2:
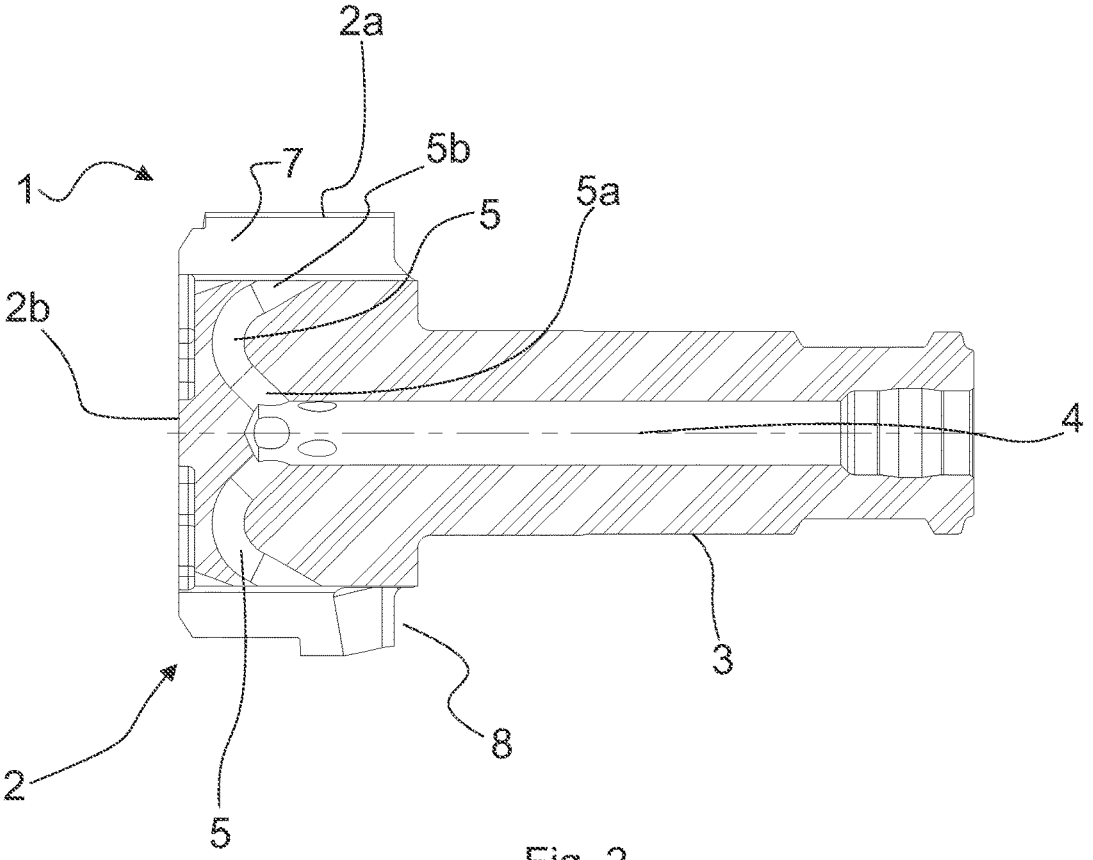

FIG. 2 illustrates a similar drill bit 1 to that of FIG. 1, except for not having face surface flushing fluid channels and providing an alternative arrangement for the lateral flushing channels 5. Particularly, the first portion 5*a* of the lateral flushing channel 5 is inclined, in the flowing direction of the flushing fluid, towards the face surface 2*b*, while the second portion 5*b* is inclined towards the hank portion 3, respectively.

Figure 3:
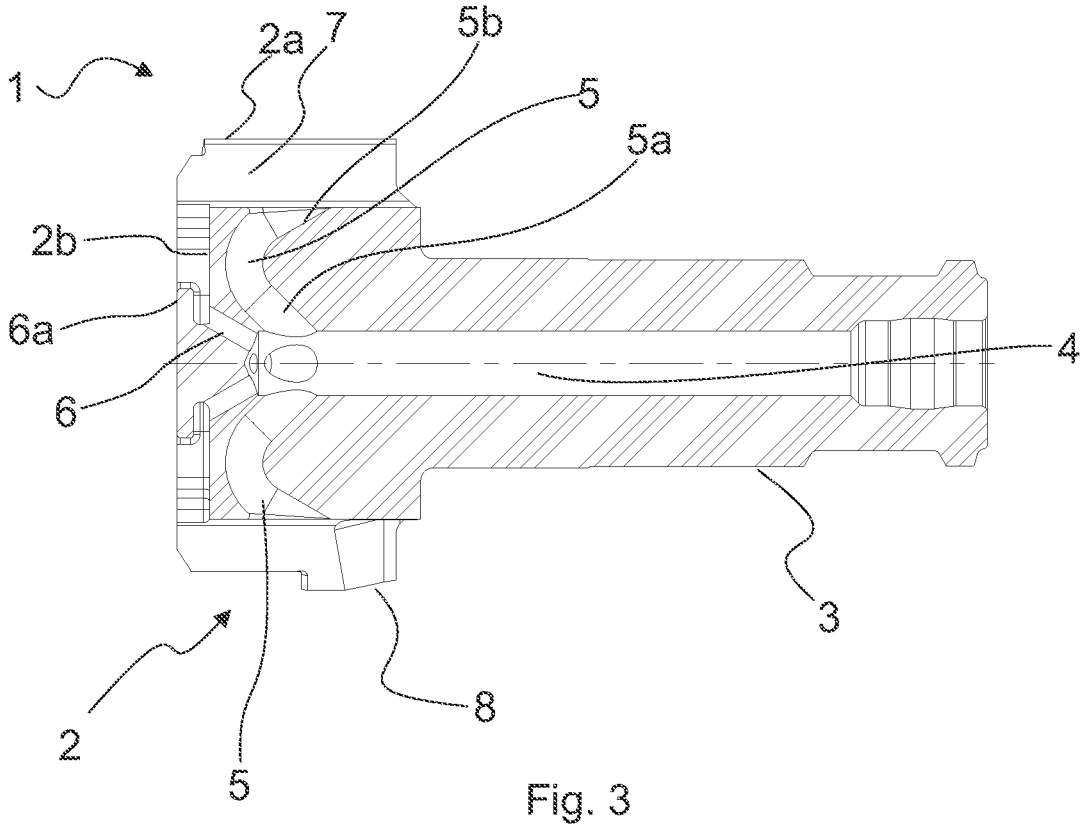

Also in FIG. 3 the first portion 5*a* of the lateral flushing channel 5 is inclined, in the flowing direction of the flushing fluid, towards the face surface 2*b*, while the second portion 5*b* is inclined towards the shank portion 3, respectively. However, differing from the drill bit 1 of FIG. 2, face surface flushing channels 6 are provided extending directly between the face surface 2*b* and the central flushing channel 4. On the face surface 2*b*, the face surface flushing channels 6 are equipped with deflecting elements 6*a*, which deflect the flushing fluid flow originating from the face surface flushing channels 6 towards the periphery of the face surface 2*b*.

Figure 4:
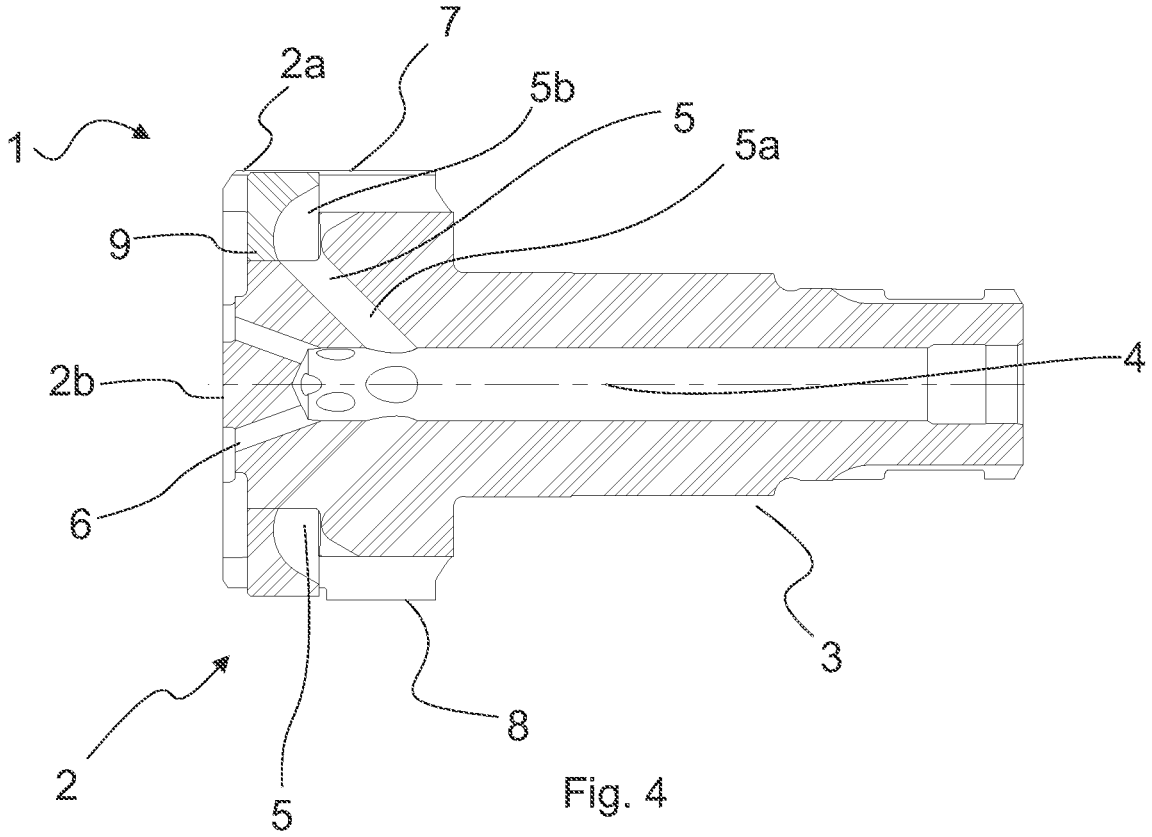

FIG. 4 illustrates a cut-view of a similar embodiment as that shown in FIG. 3, apart from not having deflecting elements, and a part of the head portion 2 being provided as a separate section 9 attached to the rest of drill bit 1. Particularly, a part of the second portion 5*b* of the lateral flushing channel 5 and the transition region between the first portion 5*a* and the second portion 5*b* are arranged on the separate section 9.

Figure 5:
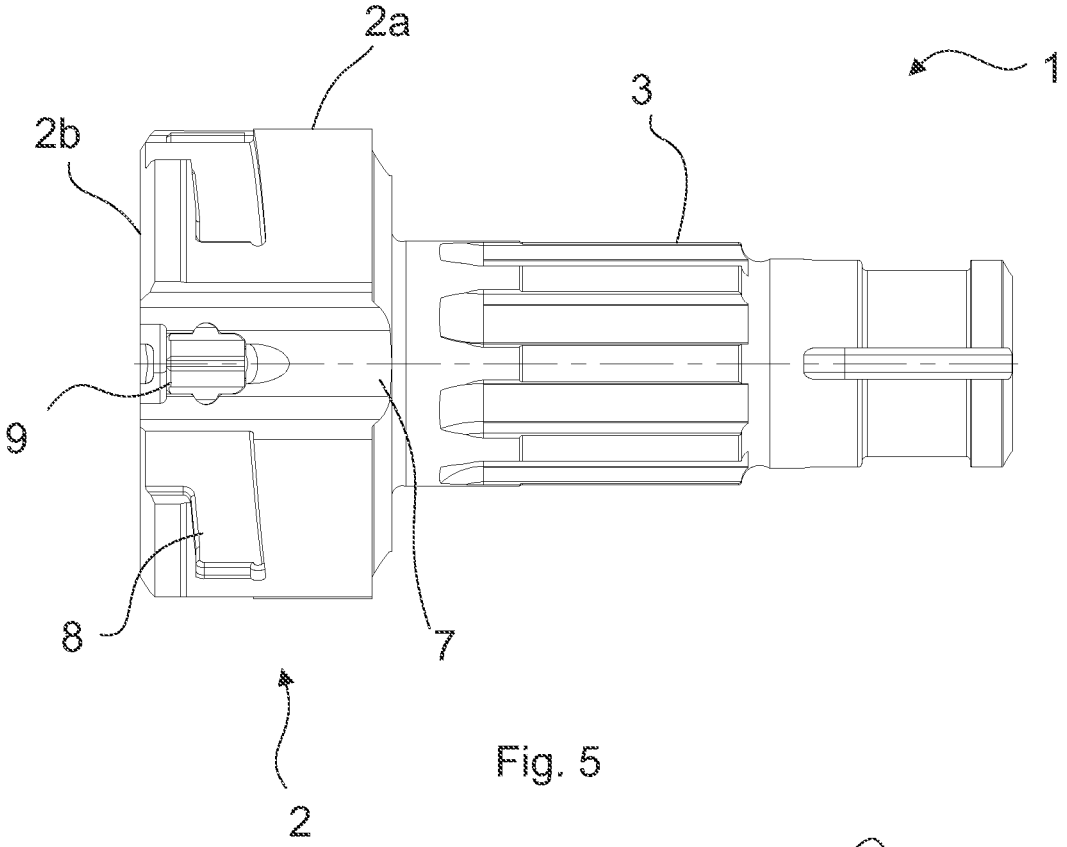
FIG. 5 and FIG. 6 illustrate alternate views of the embodiment in FIG. 4.

FIG. 5 illustrates the drill bit of FIG. 4 as a side view. Particularly, it shows the tongue-and-groove arrangement between the separate section 9 and the head portion 2.

Figure 6:
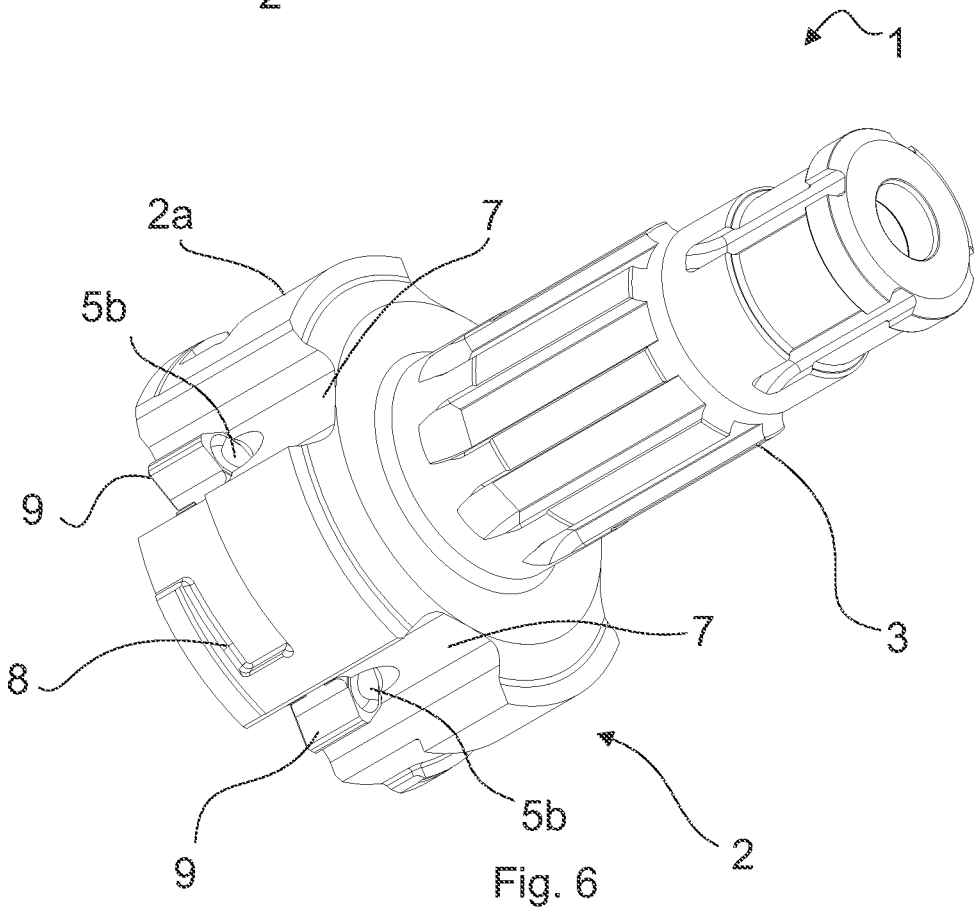
Figure 7:
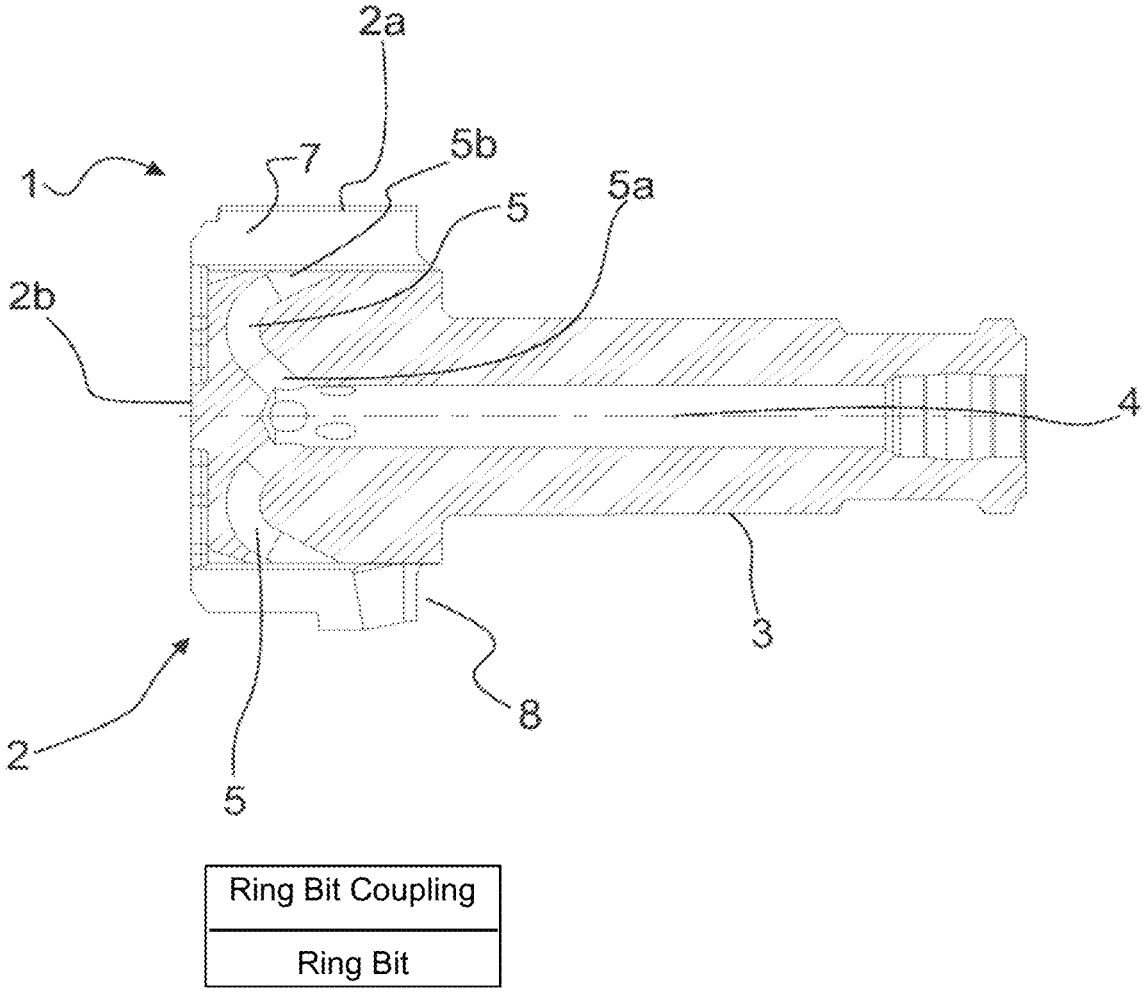
FIG. 7 illustrates an alternative embodiment of the drill bit according to the disclosure including an annular ring bit and an annular ring bit coupling means.

FIG. 6 illustrates the drill bit of FIG. 4 as seen as a perspective view. Particularly, it shows how the separate sections 9 are positioned within respective flushing grooves 7 and extend radially therefrom. Moreover, the second portion 5*b* is partially formed within the separate section 9.

According to a first aspect of the present disclosure, a drill bit 1 for percussive drilling is provided.

The drill bit 1 comprises a head portion 2 having a circumference 2*a* and a face surface 2*b*, the face surface being arranged for receiving a plurality of inserts for cutting rock. Moreover, the face surface is arranged for drilling ground, i.e. crushing ground material into drill cuttings, when in use. The drill bit 1 further comprises a shank portion 3 extending longitudinally from a side of the head portion 2 opposite to the face surface 2*b*. The shank portion 3 is arranged for coupling the drill bit 1 to a drill string in a rotation and percussion transmitting manner. Preferably, but not necessarily, the shank portion may be coupled, for example, to a hammer or a drill rod.

A central flushing channel 4 extends longitudinally through the shank portion 3 and a distance within the head portion 2. In the context of this disclosure, the longitudinal axis of the drill bit 1 is considered as running in the direction in which the shank portion 3 extends. Moreover, a lateral flushing channel 5 extends from the central flushing channel 4 to the circumference 2*a* of the head portion 2. It should be noted, that the lateral flushing channel 5 itself does not need to be directly lateral, i.e. a straight channel extending directly in the lateral direction, but may be curved and/or inclined in one or more directions.

The central flushing channel 4 is arranged to conduct flushing fluid coming from the surface along the drill string to the drill bit, and further, out of the drill bit, via at least the lateral flushing channel 5. The purpose of the flushing fluid is to flush drill cuttings away from the bottom of the drill hole and convey the drill cuttings to the surface within the drill hole, preferably within a casing pipe. That is, the drill cuttings are carried away by the flushing fluid from the front of the face surface 2*b*. Flushing the drill cuttings may further be enhanced by providing a face surface flushing channel 6, as discussed in detail later on.

The lateral flushing channel 5 comprises a first portion 5*a* connecting said lateral flushing channel to the central flushing channel 4, and a second portion 5*b* connecting said lateral flushing channel to the circumference 2*a* of the head portion 2. Particularly, the first portion 5*a* is inclined, in a flushing fluid flowing direction, towards the face surface 2*b* with respect to the second portion 5*b*. Correspondingly, the second portion 5*b* is inclined, in a flushing fluid flowing direction, towards the shank portion 3 with respect to the first portion 5*a*. Suitably, the second portion 5*b* of the lateral flushing channel 5 directs flushing fluid flow towards the ground surface, i.e. is inclined towards the shank portion in the flushing fluid flowing direction. This ensures that flushing fluid flow originating from the lateral flushing channel 5 to flow towards the surface with minimal disturbance and turbulence of the flow. Particularly little of the flow's kinematic energy is lost in colliding with an inner periphery of a ring bit, for example.

It should be noted that the first portion 5*a* and the second portion 5*b* do not necessarily need to be inclined in an absolute manner the towards the face surface 2*b* and shank portion 3, respectively, but the above refers to the mutually respective inclinations of the first and second portions 5*a*, 5*b* of the lateral flushing channel 5. Moreover, in the context of this disclosure, the term 'inclined' is used for describing the general orientation of the first and second portion 5*a*, 5*b* of the lateral flushing channel 5. Correspondingly, the disclosure encompasses arrangements in which the lateral flushing channels are, for example, curved. Moreover, the present disclosure encompasses arrangements in which both the first and second portions 5*a*, 5*b* are directed towards the shank portion in a flushing fluid flowing direction, while the first portion 5*a* is inclined towards the face surface 2*b* with respect to the second portion 5*b*, and the second portion 5*b* is inclined towards the shank portion 3 with respect to the first portion 5*a*.

This arrangement ensures that the direction of the flushing fluid coming from the surface, and directed back to the surface, may be redirected gradually. That is, in order for the flushing fluid to enter the lateral flushing channel 5, it is not necessary for the flushing fluid to deflect into the direction it is desired to exit the lateral flushing channel 5 (i.e. the direction of the second portion 5*b*), but rather it is sufficient for the flushing fluid to deflect less (in to the direction of the first portion 5*a*). This, in turn, results in a smoother flow route, and consequently, in a smaller flow resistance of the flushing fluid as compared to the conventional arrangement of providing a lateral flushing channel as a straight, backwardly inclined conduit drilled from the circumference 2*a* to the central flushing channel. As a smaller flow resistance is achieved, a larger flushing fluid flow is obtained with a given feed pressure, which translates into a higher flushing capacity of the drill cuttings.

Moreover, it has been discovered, that providing a flushing fluid flow from the circumference 2*a* of the head portion towards the shank portion 3, i.e. away from the face surface 2*b*, will create a pressure differential between the surroundings of the circumference 2*b* and that of the face surface 2*b*, such that drill cuttings having drifted near the circumference 2*b* will be drawn up to the surface along with the flushing fluid flow form the lateral flushing channel 5. This enables drill cuttings to be flushed to the surface from the bottom of the drill hole while directing little or none of the flushing fluid to the face surface 2*b*. The risks associated to sensitive ground conditions, i.e. over drilling and/or damaging existing ground structures by flushing fluid travelling within ground formations, is minimized, particularly when the flushing fluid returning to the surface flows within a casing pipe. The drill bit 1 according to the disclosure enables further reducing the risks associated to sensitive ground conditions, as a larger flushing fluid flow and/or larger proportion of the flushing fluid flow may be introduced via the lateral flushing channels 5 with a given feed pressure.

Moreover, to further enhance these benefits, the lateral flushing channel 5 may comprise one or more intermediate portions between the first portion 5*a* and second portion 5*b*. In addition, the first portion 5*a*, second portion 5*b* and any possible intermediate portions may be provided with a smooth transitions therebetween.

According to an embodiment of the first aspect of the disclosure, the first portion 5*a* is directed between a direction transverse to the central flushing channel 4 and a direction parallel to the central flushing channel 4 towards the face surface 2*b*. That is, the first portion 5*a* is directed in either of these directions or any direction therebetween. As the first portion 5*a* of the lateral flushing channel does not extend towards the shank portion 3, the flushing fluid does not need to deflect back towards the direction it came from in order to enter the lateral flushing channel 5. This further reduces the flow resistance of the flushing fluid flowing to the lateral flushing channel 5. Moreover, the second portion 5*b* is directed towards the shank portion 3, which contributes to generating the pressure differential between the face surface 2*b* and the circumference 2*b* and enhances drill cuttings to be drawn from the surrounding of the face surface 2*b*.

According to a further embodiment of the first aspect of the disclosure, the drill bit 1 comprises a face surface flushing channel 6 extending between the central flushing channel 4 and the face surface 2*b*. Preferably, the face surface flushing channel 6 extends between the central flushing channel 4 and the face surface 2*b* via the lateral flushing channel 5, although the face surface flushing channel 6 may alternatively be arranged to extend directly between the central flushing channel and the face surface 2*b*.

Furthermore, the drill bit 1 may comprises a deflection element 6*a* arranged at a face surface 2*b* end of the face surface flushing channel 6 for deflecting flushing fluid flow prior to being introduced at the face surface 2*b*. Such a deflection element 6*a* redirects flushing fluid flowing from the face surface flushing channel 6 towards the periphery of the face surface 2*b*, i.e. towards the circumference 2*a* of the head portion 2. Such an arrangement results in the flushing fluid flow coming from the face surface flushing channel 6 blowing drill cuttings towards surroundings of the circumference 2*b*, from where the flushing fluid flow coming from the lateral flushing channel 5 will carry the drill cuttings up to the surface. Moreover, as the deflection elements 6*a* direct the associated flushing fluid towards the circumference 2*b*, a smaller flow rate of the flushing fluid flowing through the face surface flushing channel 6 is required, and consequently, risks associated to sensitive ground conditions is further minimized.

According to another embodiment of the first aspect of the disclosure, the drill bit 1 comprises, for each lateral flushing channel 5, at least two face surface flushing channels 6 extending between the central flushing channel 4 and the face surface 2*b*, preferably via said lateral flushing channel 5. As a result, the flushing fluid flow to the face surface 2*b* is more evenly distributed thereon, and the velocity of the flushing fluid introduced to the face surface 2*b* may be lowered while maintaining a similar flow rate. Reducing the flow velocity further contributes to minimizing risk associated to sensitive ground conditions, as a high flow velocity causes over drilling in soft ground.

Advantageously, said at least two face surface flushing channels 6 corresponding to a respective lateral flushing channel 5 are spaced apart from each other on the face surface 2*b* in a direction transverse to the central flushing channel 4. Preferably, but not necessarily, said at least two face surface flushing channels 6 are spaced apart from each other at least radially.

According to a further embodiment of the first aspect of the disclosure, the drill bit 1 drill bit, as discussed in connection with any of the previous embodiments, may comprise a plurality of lateral flushing channels 5, most suitably angularly separated from each other. Such an arrangement ensures, that the pressure differential between the face surface 2*b* and the circumference 2*a*, and the fluid flow from the lateral flushing channels 5, is more evenly distributed over the circumference of the head portion 2 of the drill bit 1.

In yet another embodiment of the first aspect of the disclosure, the at least two face surface flushing channels 6, corresponding to a respective lateral flushing channel 5, are positioned on the face surface 2*b* within a sector corresponding to said respective lateral flushing channel 6. Such a sector is delimited by one or more adjacent sectors corresponding other lateral flushing channels. Moreover, such a sector does not need to be a separate section on the face surface 2*b*, but may be formed as portions of the common face surface 2*b*. In other words, the at least two face surface flushing channels 6, corresponding to a respective lateral flushing channel 5, do not need to be positioned on a face surface 2*b* projection of the associated lateral flushing channel 6, i.e. directly below the lateral flushing channel 6, but may be distanced apart therefrom.

According to a still further embodiment of the first aspect, the drill bit 1 comprises, for each lateral flushing channel 5, a flushing groove 7 on the circumference 2*a* of the head portion 2. The flushing groove 7 extends longitudinally through the head portion 2, i.e. from periphery of the face surface 2*b* towards the shank portion 3, thus enabling drill cutting to be flushed from ahead of the face surface 2*b* up to the surface past the drill bit 1. Moreover, the respective lateral flushing channel 5 extends between the central flushing channel 4 and the flushing groove 7. This ensures that the pressure differential, created by the flushing fluid flow from the lateral flushing channel 5, draws in drill cuttings from ahead of the face surface 2*b* along the flushing groove 7, further to be carried to the surface by the flow.

According to another embodiment of the first aspect, the drill bit is a pilot bit 1. Accordingly, the drill bit further comprises pilot bit coupling means 8 arranged on the circumference 2*a* of the head portion 2. The pilot bit coupling means 8. is arranged for coupling the drill bit with a ring bit in a percussion and rotation transmitting manner.

According to still a further embodiment of the first aspect, the drill bit 1 comprises a separate section 9 of the head portion 2 attached to said drill bit. Such a separate section 9 comprises at least a part of the lateral flushing channel 5, preferably at least a part of the second portion 5*b* of the lateral flushing channel 5. This arrangement enables the remaining portion of the drill bit to be produced using conventional machining tools, while still achieving a lateral flushing channel 5 according to the disclosure. Suitably, the separate section 9, and the remaining part of the drill bit 1 are equipped with a mutually corresponding tongue-and-groove arrangement for securing the separate section 9 to the drill bit, by simply inserting the separate section 9 into a corresponding recess on the drill bit 1. After insertion, the separate section may be further fastened by further fastening means, for example, by welding. Preferably, the separate section 9 is arranged to a flushing groove 7 of the drill bit 1, so as to radially extend therefrom. This provides the additional advantage, that the return route formed by the flushing groove 7, and suitably an inner circumference of a ring bit, is divided into smaller flow areas by the separate section 9. Moreover, this prevents oversized drill cuttings from entering the flushing groove 7, and potentially blocking the subsequent flow route to the surface. Naturally, more than one separate section 9 may be provided, i.e. at least one or each lateral flushing channel 5 may be at least partially formed by a separate section 9 attached to the drill bit 1.

It should be noted that any of the embodiments of the first aspect may be combined for achieving a drill bit having desired properties without deviating from the scope of this disclosure.

According to a second aspect of the disclosure, a drill bit assembly is provided. Such a drill bit assembly comprises, in addition to a drill bit 1 according to any of the embodiment discussed in connection with the first aspect, an annular ring bit. The ring bit is equipped with ring bit coupling means operationally corresponding to the pilot bit coupling means 8. When coupled, an inner circumference of the ring bit and the flushing groove 7 of a pilot bit 1 form a return flow route for flushing fluid from the lateral flushing channel 5, and preferably, the face surface flushing channel 6.

According to a third aspect of the disclosure, a method for manufacturing the drill bit 1, as discussed in connection with any of the embodiments according to the first aspect, is provided. In the method, at least a part of the head portion is produced by adding material in order to form at least a part of a lateral flushing channel 5.

According to an embodiment of the third aspect, at least a portion of the head portion is produced by additive manufacturing. Examples of such suitable additive manufacturing production methods include powder-bed systems and powder-fed systems. Preferably, but not necessarily, at least the shank portion 3, and suitably the part of the head portion 2 immediately adjacent to the shank portion 3, are prefabricated using conventional production methods, such as machining. Thereafter, at least the part of the head portion including at least a part of a lateral flushing channel 5, suitably the rest of the drill bit 1, is produced by additive manufacturing. Alternatively, the whole drill bit 1 may be produced using additive manufacturing.

According to another embodiment of the third aspect, the drill bit is produced such that at least one lateral flushing channel is formed by providing a first opening extending between the central flushing channel 4 and the circumference 2*b* of the head portion 2, such that a portion of the first opening corresponds to the first portion 5*a* of the lateral flushing channel 5. Moreover, a second opening is provided extending between first opening and the circumference 2*b* of the head portion 2, such that the second opening corresponds to the second portion 5*b* of the lateral flushing channel 5. Thereafter, a portion of the first opening not corresponding to the first portion 5*a* of the lateral flushing channel 5, is filled, for example by welding.

According to a further embodiment of the third aspect, at least a part of the head portion 2 is produced separately from the rest of the drill bit as a separate section 9, and subsequently attached thereto. Preferably, a section 9 of the head portion 2 comprising at least a part of the lateral flushing channel 5, more preferably at least a part of the second portion 5*b* of the lateral flushing channel 5, is manufactured as a section separate from the rest of the drill bit 1. For example, the rest of the drill bit 1 and such a separate section 9 may be arranged to have co-operating forms, such that the said separate section 9 is receivable by the drill bit 1 simply by inserting by inserting said separate section into a corresponding recess in the drill bit. After being inserted, such a separate section is preferably secured to the drill bit 1 using conventional means, such as various fastening elements or by welding. Preferably, but not necessarily, such a separate portion 9 is arranged on the drill bit so as to extend radially from a respective flushing groove 7, thus effectively dividing the flow area of the flushing groove into two smaller areas. This prevents over-sized drill cuttings from entering the flushing groove, and potentially blocking the return route for the flushing fluid flowing to the surface.

Naturally, should the drill bit 1 to be produced comprise more than one lateral flushing channel 5, multiple such sections may be produced separately and subsequently attached to the rest of the drill bit 1.

It should be noted that the drill bit 1 according to any of the embodiments discussed in connection with the first aspect of the disclosure may alternatively be produced using conventional manufacturing processes, such as moulding.

The invention claimed is:

1. A drill bit for percussive drilling, comprising:

a head portion having a circumference and a face surface, the face surface being configured for receiving a plurality of inserts;

a shank portion extending longitudinally from a side of the head portion opposite to the face surface, the shank portion being configured for coupling the drill bit to a drill string in a rotation and percussion transmitting manner;

a central flushing channel extending longitudinally through the shank portion and a distance within the head portion; and a lateral flushing channel extending from the central flushing channel to the circumference of the head portion, wherein the lateral flushing channel includes:

a first portion connecting said lateral flushing channel to the central flushing channel; and a second portion connecting said lateral flushing channel to the circumference of the head portion;

wherein said first portion is inclined, in a flushing fluid flowing direction, towards the face surface with respect to said second portion and correspondingly, said second portion is inclined, in a flushing fluid flowing direction, towards the shank portion with respect to said first portion;

wherein said drill bit includes a plurality of lateral flushing channels angularly separated from each other, and for each lateral flushing channel, said drill bit includes:

at least two face surface flushing channels extending between the central flushing channel and the face surface; and said at least two face surface flushing channels corresponding to a respective lateral flushing channel are positioned on the face surface within a sector corresponding to said respective lateral flushing channel, said sector being delimited by one or more adjacent sectors corresponding other lateral flushing channels, wherein said drill bit is a pilot bit including pilot bit coupling means, arranged on the circumference of the head portion, for coupling the drill bit with a ring bit in a percussion and rotation transmitting manner.

2. The drill bit for percussive drilling, wherein said first portion is directed between a direction transverse to the central flushing channel and a direction parallel to the central flushing channel towards the face surface; and said second portion is directed towards the shank portion.

3. The drill bit according to claim 2, wherein said first portion is directed in a direction transverse to the central flushing channel.

4. The drill bit according to claim 2, wherein said first portion is directed towards the face surface.

5. The drill bit according to claim 4, comprising:

a deflection element arranged at a face surface end of the face surface flushing channel for deflecting flushing fluid flow prior to being introduced at the face surface.

6. The drill bit according to claim 5, wherein said at least two face surface flushing channels corresponding to a respective lateral flushing channel are spaced apart from each other on the face surface in a direction transverse to the central flushing channel.

7. The drill bit according to claim 6, comprising:

for each lateral flushing channel, on the circumference of the head portion, a flushing groove extending longitudinally through the head portion, wherein the respective lateral flushing channel extends between the central flushing channel and the flushing groove.

8. The drill bit according to claim 1, comprising:

a deflection element arranged at a face surface end of the face surface flushing channel for deflecting flushing fluid flow prior to being introduced at the face surface.

9. The drill bit according to claim 1, wherein said at least two face surface flushing channels corresponding to a respective lateral flushing channel are spaced apart from each other on the face surface in a direction transverse to the central flushing channel.

10. The drill bit according to claim 1, comprising:

for each lateral flushing channel, on the circumference of the head portion, a flushing groove extending longitudinally through the head portion, wherein the respective lateral flushing channel extends between the central flushing channel and the flushing groove.

11. The drill bit according to claim 1, comprising:

a separate section of the head portion attached to said drill bit, wherein the separate section includes at least a part of the lateral flushing channel.

12. A drill bit assembly, comprising: the drill bit according to claim 1; and an annular ring bit equipped with ring bit coupling means operationally corresponding to the pilot bit coupling means; and wherein, when coupled, an inner circumference of the ring bit and the flushing groove form a return flow route for flushing fluid from the lateral flushing channel.

13. The drill bit assembly according to claim 12, wherein, when coupled, an inner circumference of the ring bit and the flushing groove form a return flow route for flushing fluid from the face surface flushing channel.

14. The drill bit according to claim 1, wherein for each lateral flushing channel, said drill bit includes:

the at least two face surface flushing channels extending between the central flushing channel and the face surface via said lateral flushing channel.

15. The drill bit according to claim 1, wherein said at least two face surface flushing channels corresponding to a respective lateral flushing channel are spaced apart from each other on the face surface in a direction transverse to the central flushing channel, at least radially.

16. The drill bit according to claim 1, comprises:

a separate section of the head portion attached to said drill bit, wherein the separate section includes at least a part of the second portion of the lateral flushing channel.

17. A method for manufacturing a drill bit having a head portion having a circumference and a face surface, the face surface being configured for receiving a plurality of inserts;

a shank portion extending longitudinally from a side of the head portion opposite to the face surface, the shank portion being configured for coupling the drill bit to a drill string in a rotation and percussion transmitting manner;

a central flushing channel extending longitudinally through the shank portion and a distance within the head portion; and a lateral flushing channel extending from the central flushing channel to the circumference of the head portion, wherein the lateral flushing channel includes:

a first portion connecting said lateral flushing channel to the central flushing channel; and a second portion connecting said lateral flushing channel to the circumference of the head portion;

wherein said first portion is inclined, in a flushing fluid flowing direction, towards the face surface with respect to said second portion and correspondingly, said second portion is inclined, in a flushing fluid flowing direction, towards the shank portion with respect to said first portion;

wherein said drill bit includes a plurality of lateral flushing channels angularly separated from each other, and for each lateral flushing channel, said drill bit includes:

at least two face surface flushing channels extending between the central flushing channel and the face surface; and said at least two face surface flushing channels corresponding to a respective lateral flushing channel are positioned on the face surface within a sector corresponding to said respective lateral flushing channel, said sector being delimited by one or more adjacent sectors corresponding other lateral flushing channels, wherein said drill bit is a pilot bit including pilot bit coupling means, arranged on the circumference of the head portion, for coupling the drill bit with a ring bit in a percussion and rotation transmitting manner, the method comprising:

additively manufacturing at least a part of the head portion by adding material to form at least a part of a lateral flushing channel.

* * * * *